US006179719B1

(12) United States Patent
Hwang

(10) Patent No.: US 6,179,719 B1
(45) Date of Patent: Jan. 30, 2001

(54) GOLF BALL DISPENSER

(76) Inventor: Kee Y. Hwang, 10320 Judy Ave., Cupertino, CA (US) 95014

( * ) Notice: Under 35 U.S.C. 154(b), the term of this patent shall be extended for 0 days.

(21) Appl. No.: 09/318,458

(22) Filed: May 25, 1999

(51) Int. Cl.[7] ..... A63B 57/00
(52) U.S. Cl. ..... 473/137
(58) Field of Search ..... 473/132–137

(56) References Cited

U.S. PATENT DOCUMENTS

| | | | | |
|---|---|---|---|---|
| 2,171,299 | | 8/1939 | Beckett . | |
| 3,003,770 | * | 10/1961 | Jones | 473/134 |
| 3,599,983 | | 8/1971 | Melton . | |
| 4,265,453 | * | 5/1981 | Loof | 473/134 |
| 4,796,893 | * | 1/1989 | Choi | 473/137 |
| 4,957,296 | * | 9/1990 | Turnidge et al. | 473/137 |
| 4,995,614 | | 2/1991 | Tange . | |
| 5,348,305 | * | 9/1994 | Lowe | 473/133 |
| 5,464,223 | * | 11/1995 | Dermott | 473/137 |
| 5,549,518 | | 8/1996 | Wang . | |
| 5,624,325 | | 4/1997 | Smith . | |
| 5,971,862 | * | 10/1999 | Yates | 473/137 |

* cited by examiner

*Primary Examiner*—Steven Wong
(74) *Attorney, Agent, or Firm*—Jack Lo

(57) ABSTRACT

A golf ball dispenser is comprised of a housing with a funnel for receiving golf balls which are simply poured in. A sloped track is connected between an aperture on the bottom of the funnel and a hole on a side of the housing. A lever arm has an inner end positioned through the hole and hinged to the housing. The lever arm is biased to an up position by a weight on the inner end. An agitator is positioned adjacent the aperture on the funnel and linked to the inner end of the lever arm by a rod for agitating the balls into the aperture whenever the lever arm is operated. A hump is provided at an intermediate point along the track for stopping the balls before they reach the hole in the housing. A ratcheting tab has one end hinged to the inner end of the lever arm, and another end positioned below the hump in the track. When the lever arm is pivoted down by a golf club, the golf ball at the hump is lifted by the ratcheting tab over the hump. The ball is delivered by the remaining portion of the track to the inner end of the lever arm, and delivered to the ground by the lowered lever arm.

7 Claims, 4 Drawing Sheets

GOLF BALL DISPENSER

BACKGROUND OF THE INVENTION

1. Field of the Invention

This invention relates generally to golf ball dispensers.

2. Prior Art

A golfer practicing driving or putting typically must bend over to pick up a ball from a bucket nearby, place it on the ground, and get back up into a swinging position. Over the course of a practice session, this tedious process must be repeated dozens or hundreds of times.

Various golf ball dispensers are disclosed in the prior art for eliminating the need to bend over and position the ball manually. A dispenser disclosed in U.S. Pat. No. 5,624,325 to Smith is comprised of a funnel for directing balls onto a sloped track. A hinged arm at the lower end of the track is pivoted to a lowered position by a golf club for directing a ball down along the arm and onto a tee. However, the balls do not reliably feed from the funnel because they sometimes tend to get stuck at the bottom of the funnel. When the balls are almost as large as the bottom opening of a funnel, they tend to get stuck easily. Similar devices are disclosed in U.S. Pat. No. 5,549,518 to Wang and U.S. Pat. No. 3,599,983 to Melton. A dispenser disclosed in U.S. Pat. No. 4,995,614 to Tange is comprised of a tall housing with a zigzag course for the balls. The balls must be fed into the housing one at a time. The housing is inconveniently tall. A device disclosed in U.S. Pat. No. 2,171,299 to Beckett is comprised of a housing with a spiral track for feeding balls to a hinged arm. Although very wide, the spiral track can only hold a relatively small number of balls in single layer.

All prior art golf ball dispensers are too large and oddly shaped to be easily carried around a golf course. They either do not feed the balls reliably, or require the balls to be fed into a magazine one at a time.

OBJECTS OF THE INVENTION

Accordingly, objects of the present golf ball dispenser are:

to dispense golf balls one at a time;

to be operable by a golfer standing upright;

to have a large capacity for golf balls;

to be able to receive poured-in golf balls;

to feed golf balls reliably;

to be small and compact enough to be easily carried around a golf course for picking up golf balls.

Further objects of the present invention will become apparent from a consideration of the drawings and ensuing description.

BRIEF SUMMARY OF THE INVENTION

A golf ball dispenser is comprised of a housing with a funnel for receiving golf balls which are simply poured in. A sloped track is connected between an aperture on the bottom of the funnel and a hole on a side of the housing. A lever arm has an inner end positioned through the hole and hinged to the housing. The lever arm is biased to an up position by a weight on the inner end. An agitator is positioned adjacent the aperture on the funnel and linked to the inner end of the lever arm by a rod for agitating the balls into the aperture whenever the lever arm is operated. A hump is provided at an intermediate point along the track for stopping the balls before they reach the hole in the housing. A ratcheting tab has one end hinged to the inner end of the lever arm, and another end positioned below the hump in the track. When the lever arm is pivoted down by a golf club, the golf ball at the hump is lifted by the ratcheting tab over the hump. The ball is delivered by the remaining portion of the track to the inner end of the lever arm, and delivered to the ground by the lowered lever arm.

DRAWING REFERENCE NUMERALS

| | |
|---|---|
| 10. Housing | 11. Handle |
| 12. Funnel | 13. Plate |
| 14. Aperture | 15. Track |
| 16. Agitator | 17. Recess |
| 18. Connecting Rod | 19. Hole |
| 20. Lever Arm | 21. Hole |
| 22. Tip | 23. Ring |
| 24. Hump | 25. Recess |
| 26. Ball | 27. Ball |
| 28. Ball | 29. Ratcheting Tab |
| 30. Bracket | |

DETAILED DESCRIPTION OF THE INVENTION

Figure 1:
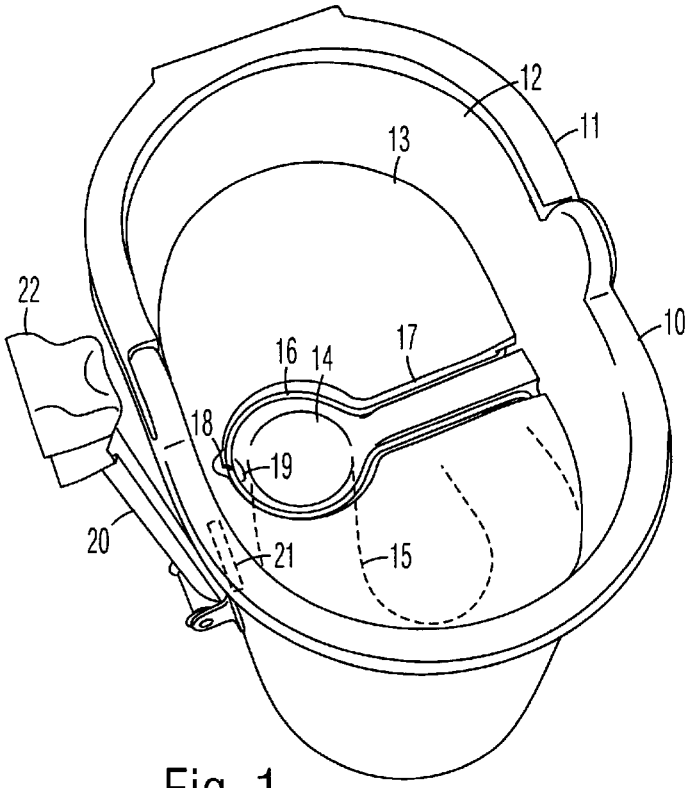
FIG. 1 is a top perspective view of the present golf ball dispenser with a lever arm in an up position.

FIG. 1:

A preferred embodiment of the golf ball dispenser is shown in a top perspective view in FIG. 1. It is comprised of a housing 10 which is preferably in the shape of a bucket for compactness. A pivoting handle 11 is attached to the top of housing 10. A large capacity funnel 12 for receiving golf balls is defined near the top of housing 10 by a slightly concave plate 13 positioned inside housing 10. Golf balls may be simply poured into funnel 12. An aperture 14 at the bottom of funnel 12 is connected to the top of a sloped track 15 extending below funnel 12. An agitator 16 has a movable annular end positioned around aperture 14 and another end hinged to housing 10. Agitator 16 is positioned inside a recess 17 on plate 13. The movable end of agitator 16 is preferably a ring positioned around aperture 14, but it may be of other shapes. A lever arm 20 has an angled inner end positioned through a hole 21 on a side of housing 10 below funnel 12, and also hinged to housing 10 adjacent hole 21. Lever arm 20 has a concave top surface for guiding golf balls, and a concave tip 22 for being engaged by a golf club. Lever arm 20 is normally biased to the up position by a weight at its inner end. The top of a connecting rod 18 is movably positioned through the movable end of agitator 16. The lower end of connecting rod 18 is connected to the inner end of lever arm 20 through a hole 19 in plate 13.

Figure 2:
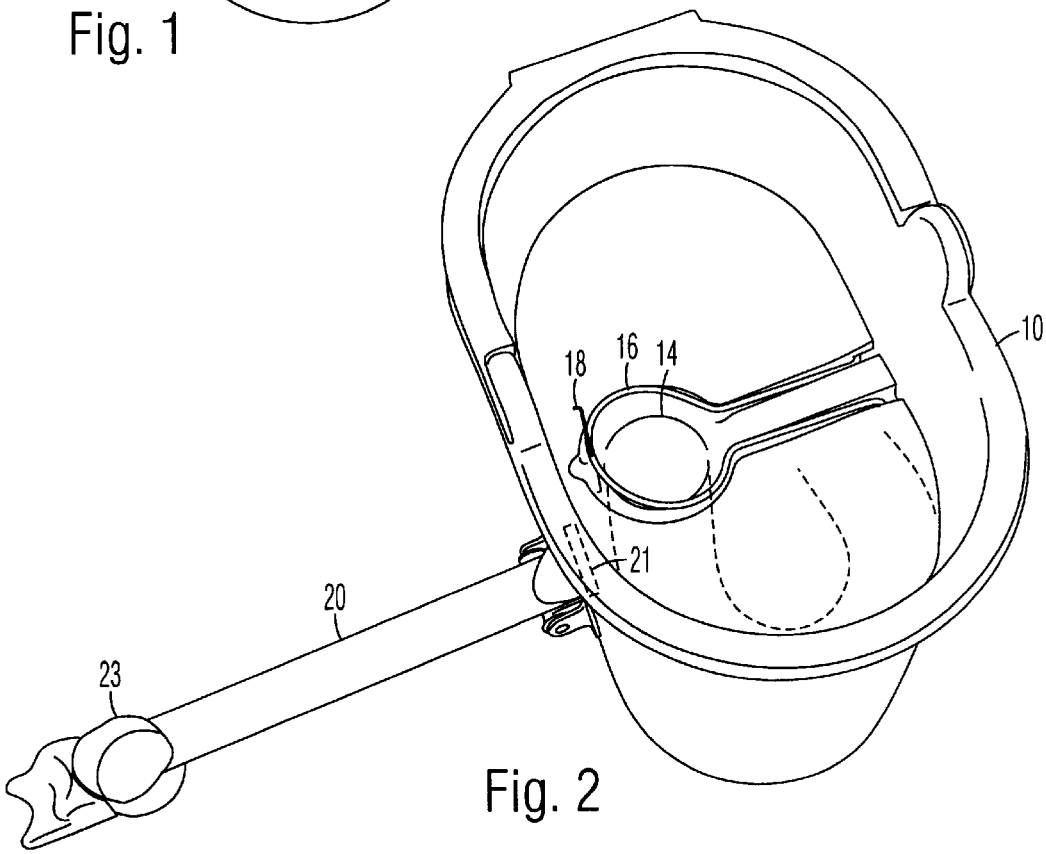
FIG. 2 is a top perspective view of the golf ball dispenser with the lever arm in a down position.

FIG. 2:

When lever arm 20 is depressed to a fully down position by a golf club while a golfer is standing upright, it is sloped downwardly from the hinged inner end to the outer end. A golf ball would roll through hole 21 on housing 10, roll down along lever arm 20, and fall through a ring 23 at the end of arm 20. When lever arm 20 is depressed, connecting rod 18 is moved upwardly. When a stop at an intermediate position on connecting rod 18 is engaged against the bottom of agitator 16, agitator 16 is moved upwardly, as shown in FIG. 2. When lever arm 20 is released back to its up position, agitator 16 is lowered. Agitator 16 is thus moved up and down each time lever arm 20 is operated, thereby agitating the golf balls around aperture 14 to prevent them from sticking, and ensure that they fall into aperture 14.

Figure 3:
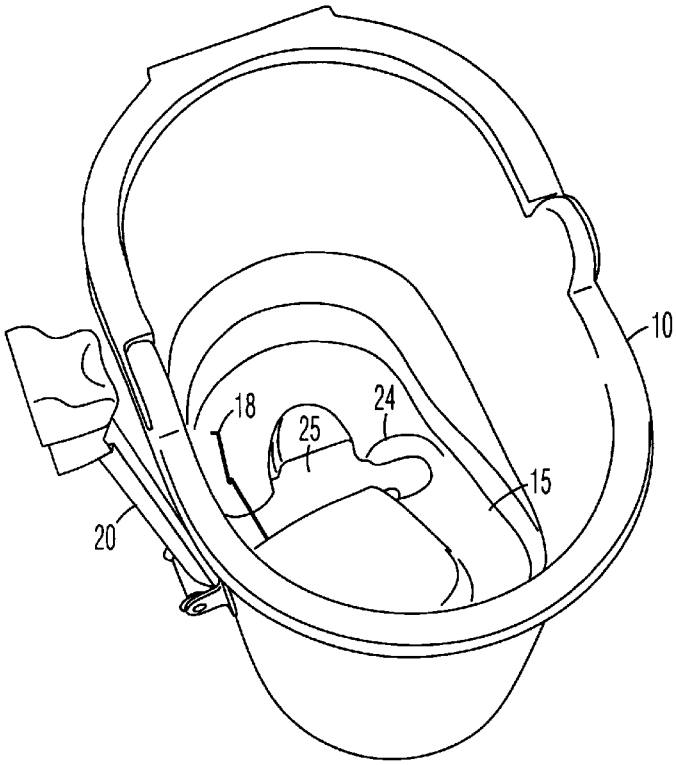
FIG. 3 is a top perspective view of the golf ball dispenser an internal track exposed for viewing.

FIG. 3:

The dispenser is shown in FIG. 3 without plate 13 (FIG. 1) to clearly show track 15 and other elements. A first portion of track 15 is attached to plate 13, so that only the remaining portion is shown. Track 15 may be of any shape, but it is preferably a spiral track which is wound around the interior of housing 10, so that an intermediate portion of track 15 is generally perpendicular to lever arm 20. A raised hump 24 is arranged along the intermediate portion of track 15. A recess 25 is positioned across track 15 immediately before hump 24. A lower end of connecting rod 18 is hinged to the inner end of lever arm 20, which is hidden within recess 25.

Figure 4:
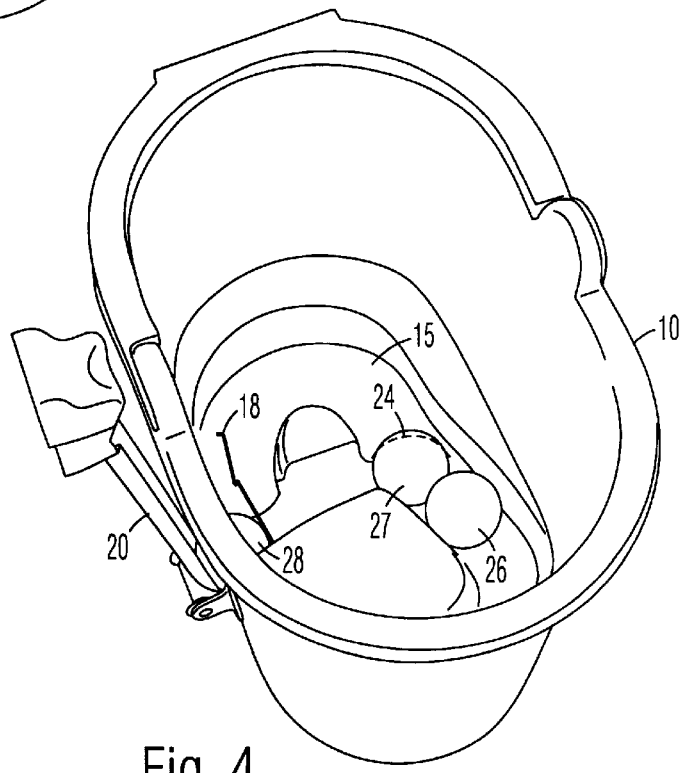
FIG. 4 is a top perspective view of the golf ball dispenser with golf balls in the track.

FIGS. 4–8:

The operation of the dispenser is illustrated in FIGS. 4–8. In FIG. 4, several golf balls 26–28 are positioned in the dispenser at various points along a ball path. Ball 28 is already positioned at the inner end of lever arm 20, ball 27 is stopped along track 15 at hump 24, and ball 26 is behind ball 27. Lever arm 20 is in the fully up position.

Figure 5:
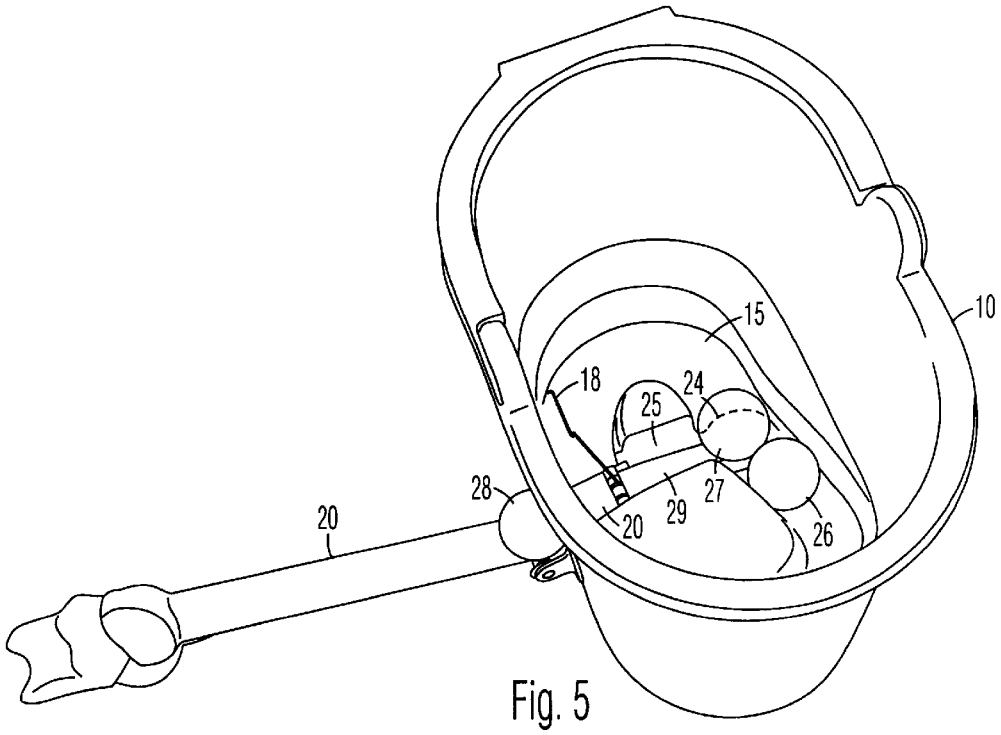
FIG. 5 is a top perspective view of the golf ball dispenser in a first step in dispensing a golf ball.

In FIG. 5, when lever arm 20 is partially lowered, a ratcheting tab 29 hinged to the inner end of lever arm 20 is raised up from within recess 25 where it is normally positioned. The inner end of arm 20 inside housing 10 is angled upwardly relative to the outer portion. Ball 27 is lifted by the distal end of ratcheting tab 29.

Figure 6:
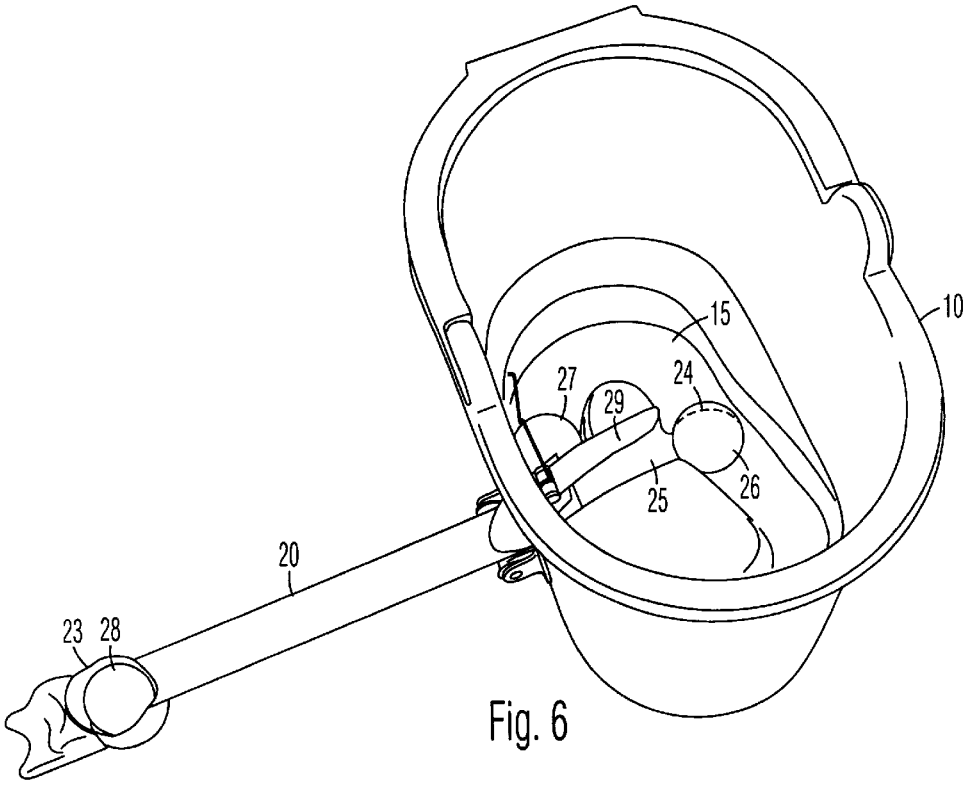
FIG. 6 is a top perspective view of the golf ball dispenser in a second step in dispensing the golf ball.

In FIG. 6, when lever arm 20 is fully lowered, ball 27 is lifted over hump 24 by ratcheting tab 29, and is rolled down track 15 until it is stopped against the inner end of lever arm 20. Ratcheting tab 29 is shown in its lowermost position in FIG. 6. Ball 28 is rolled down lever arm 20 and into ring 23. Ball 26 is rolled down track 15 until it is stopped at hump 24.

Figure 7:
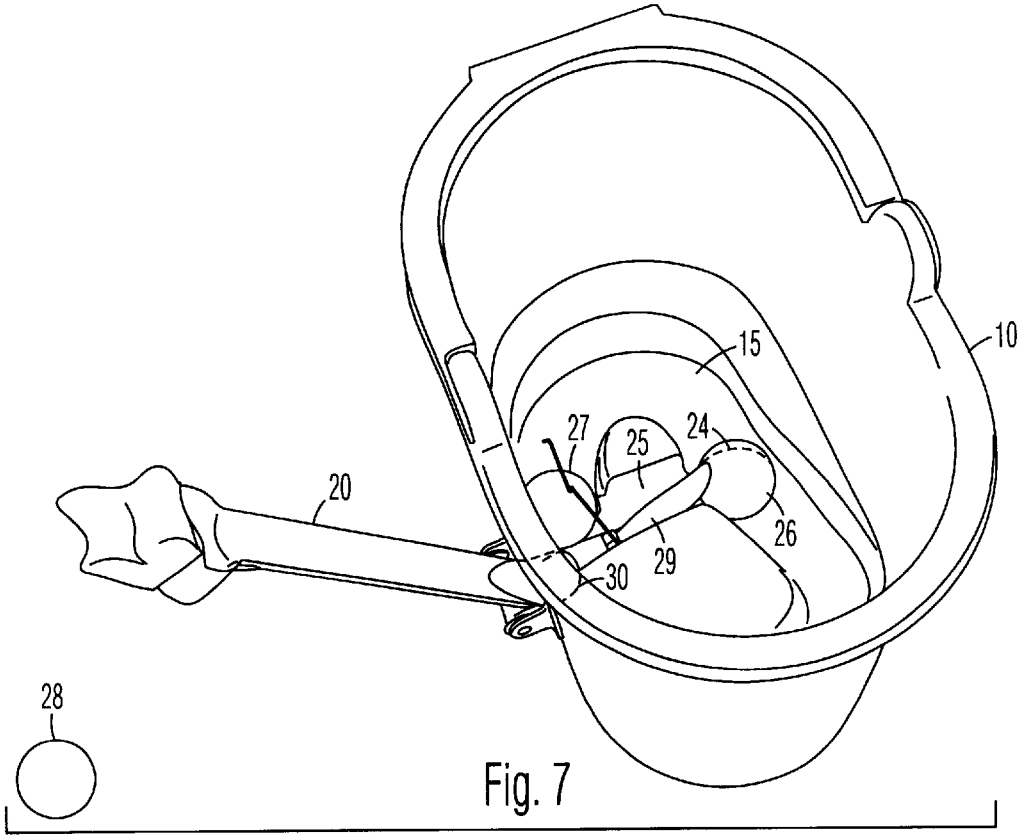
FIG. 7 is a top perspective view of the golf ball dispenser in a third step in dispensing the golf ball.

In FIG. 7, when lever arm 20 is partially released back to its up position, ball 28 is left on the ground, and ratcheting tab 29 is partially lowered. Ratcheting tab 29 is pivoted upwardly when engaged against ball 26. A bracket 30 is attached to the inner end of lever arm 20 for later supporting ball 27.

Figure 8:
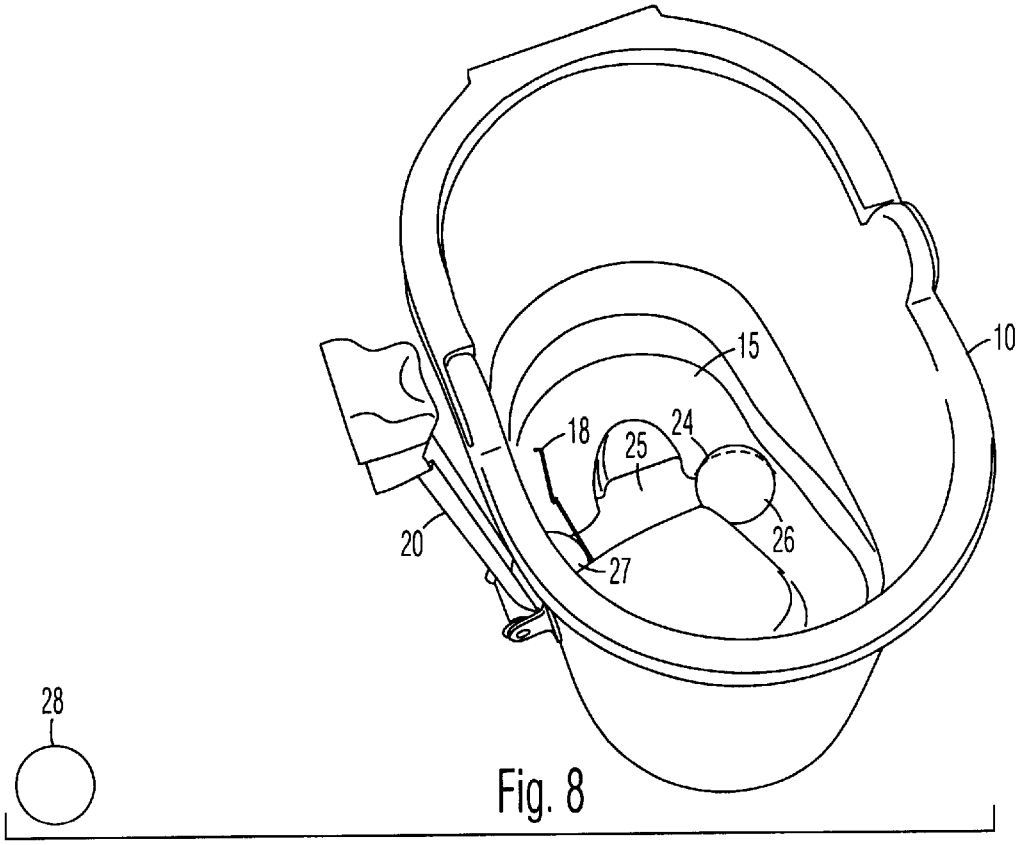
FIG. 8 is a top perspective view of the golf ball dispenser in a fourth step in dispensing the golf ball.

In FIG. 8, when lever arm 20 is fully raised, ball 27 is dropped onto the inner end of lever arm 20 on top of bracket 30 (FIG. 7). Ratcheting tab 29 (FIG. 7) is dropped below ball 26, back into recess 25. Ball 28 is positioned on the ground outside the dispenser, ready for play.

SUMMARY AND SCOPE

Accordingly, an improved golf ball dispenser is provided. It dispenses golf balls one at a time. It is operable by a golfer standing upright. It has a large capacity for golf balls. It is able to receive poured-in golf balls. It feeds golf balls reliably. It is also small and compact enough to be easily carried around a golf course for picking up golf balls.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A golf ball dispenser, comprising:

a funnel positioned for receiving golf balls which are poured in;

a sloped track with an upper end connected to an aperture on a bottom of said funnel for receiving said balls falling through said aperture;

a lever arm with an inner end connected to a lower end of said track for receiving said balls from said track, a distal end of said lever arm being pivotable between a raised position and a lowered position, said lever arm for delivering said balls to a ground when pivoted to said lowered position;

a movable agitator positioned adjacent said aperture on said funnel and connected to said lever arm for agitating said balls into said aperture whenever said lever arm is operated;

a hump positioned at an intermediate point along said track for stopping said balls before said balls reach said lever arm; and a ratcheting tab with a proximal end hinged to said inner end of said lever arm, and a movable distal end positioned below said hump in said track, wherein when said lever arm is lowered, said distal end of said ratcheting tab is raised for lifting one of said golf balls on said track over said hump and onto a lower portion of said track for delivery to said inner end of said lever arm.

2. The golf ball dispenser of claim 1, wherein said agitator includes a proximal end hinged to said funnel, and a movable distal end positioned adjacent said aperture on said funnel, said agitator connected to said lever arm by a rod, so that said agitator is pivoted whenever said lever arm is pivoted for agitating said balls into said aperture.

3. The golf ball dispenser of claim 1, wherein said agitator includes a proximal end hinged to said funnel, and a movable annular distal end positioned around said aperture on said funnel for agitating said balls around said aperture with a pivoting movement.

4. The golf ball dispenser of claim 1, further including a weight attached to said inner end of said lever arm biasing said lever arm to said raised position.

5. The golf ball dispenser of claim 1, further including a bucket fixedly housing said funnel and said sloped track for convenient carrying, said funnel communicating with an open top of said bucket.

6. The golf ball dispenser of claim 1, further including a bucket fixedly housing said funnel and said sloped track for convenient carrying, said funnel communicating with an open top of said bucket, said inner end of said lever arm extending through a hole on a side of said bucket, said lever arm pivoted to said bucket adjacent said hole.

7. The golf ball dispenser of claim 1, further including a connecting rod connecting said agitator to said lever arm.

* * * * *